US009821431B2

(12) United States Patent
Chou et al.

(10) Patent No.: US 9,821,431 B2
(45) Date of Patent: Nov. 21, 2017

(54) CHEMICAL MECHANICAL POLISHING CONDITIONER

(71) Applicant: Kinik Company, Taipei (TW)

(72) Inventors: Jui-Lin Chou, New Taipei (TW); Chia-Feng Chiu, New Taipei (TW); Wen-Jen Liao, New Taipei (TW); Xue-Shen Su, Taipei (TW)

(73) Assignee: KINIK COMPANY, Taipei (TW)

( * ) Notice: Subject to any disclaimer, the term of this patent is extended or adjusted under 35 U.S.C. 154(b) by 156 days.

(21) Appl. No.: 15/015,670

(22) Filed: Feb. 4, 2016

(65) Prior Publication Data

US 2016/0236320 A1 Aug. 18, 2016

(30) Foreign Application Priority Data

Feb. 16, 2015 (TW) ..... 104105264 A

(51) Int. Cl.
*B24B 53/00* (2006.01)
*B24B 53/017* (2012.01)

(52) U.S. Cl.
CPC ..... *B24B 53/017* (2013.01)

(58) Field of Classification Search
CPC ..... B24D 3/06; B24D 18/00; B24B 53/017; B24B 53/12; B24B 37/04
USPC ..... 451/56, 443
See application file for complete search history.

(56) References Cited

U.S. PATENT DOCUMENTS 5,762,545 A * 6/1998 Edwards ..... B24B 7/186 451/353
5,769,697 A * 6/1998 Nishio ..... B24B 37/042 451/285
6,106,382 A * 8/2000 Sakaguchi ..... B24D 3/06 451/443
6,142,859 A * 11/2000 Ross ..... B24B 37/08 451/268
6,190,243 B1 * 2/2001 Wada ..... B24B 53/017 451/285
6,213,856 B1 * 4/2001 Cho ..... B24B 53/017 451/443
6,347,981 B1 * 2/2002 Holzapfel ..... B24B 53/017 125/3

(Continued)

*Primary Examiner* — George Nguyen
(74) *Attorney, Agent, or Firm* — Fishman & Associates, LLC.

(57) ABSTRACT

Provided is a CMP conditioner comprising: a substrate, multiple abrasive bars, and multiple slide blocks. The substrate is divided into a central surface and an outer surface. The central surface is a recessed part. The outer surface encompasses the central surface. Multiple mounting holes are recessed from the outer surface. The abrasive bars are each respectively mounted in the mounting holes. Each of the multiple abrasive bars comprises a bar body and an abrasive particle. The abrasive particle is mounted on a top surface of the abrasive bar. The multiple slide blocks are distributed among the mounting holes of the outer surface. Each of the multiple slide blocks comprises a slide dressing surface. The present invention utilizes the slide blocks to reduce the contact between the substrate and a polishing mat efficiently. The slide blocks may decrease dissolving out of metal components within the substrate and the pollution induced.

22 Claims, 6 Drawing Sheets
(2 of 6 Drawing Sheet(s) Filed in Color)

(56) References Cited

U.S. PATENT DOCUMENTS

| | | | | |
|---|---|---|---|---|
| 6,439,986 | B1 * | 8/2002 | Myoung | B24B 53/017 451/443 |
| 6,945,857 | B1 * | 9/2005 | Doan | B24B 53/017 451/443 |
| 2004/0048557 | A1 * | 3/2004 | Nabeya | B24B 53/017 451/56 |
| 2006/0079160 | A1 * | 4/2006 | Balagani | B24B 53/12 451/285 |
| 2006/0276111 | A1 * | 12/2006 | Tian | B24B 53/12 451/56 |
| 2009/0093195 | A1 * | 4/2009 | Sung | B24D 3/007 451/56 |

* cited by examiner

CHEMICAL MECHANICAL POLISHING CONDITIONER

BACKGROUND OF THE INVENTION

1. Field of the Invention

The present invention relates to a chemical mechanical polishing (CMP) conditioner, and more particularly to a CMP conditioner comprising slide blocks.

2. Description of the Related Art

CMP is a planarization technique used in various processes. Because CMP is suitable for large scale planarization, CMP is widely applied to planarization of silicon surfaces or copper surfaces after stacking of integrated circuits.

An apparatus of CMP usually comprises a polishing pad and a CMP conditioner. During a CMP process, a slurry is supplied on the polishing pad by spin coating, and then a surface of an article to be polished is pressed against the polishing pad to polish the surface of the article. The surface of the article is planarized by the grinding and polishing process with the polishing pad.

However, scraps produced during the polishing process accumulate and stagnate in holes of the polishing pad, forming a hardened layer. The hardened layer decreases the polishing efficiency of the polishing pad and shortens the lifetime of the polishing pad. Therefore, the CMP conditioner is used during the CMP process to dress the surface of the polishing pad, so as to prolong the life time of the polishing pad.

In view of the abovementioned problem, patent application TW 103202785 discloses a CMP conditioner. Abrasive particles in the CMP conditioner each comprises a specific orientation of tip, a specific height of tip, or a specific dressing angle to achieve the best grinding performance. However, the abrasive particles 81 of the CMP conditioner 8 protruding into the polishing pad are deeper during the polishing process with reference to FIG. 8. The slurry in contact with the substrate 82 then induces the corrosion easily. The metal components within the substrate 82 may be dissolved out and then stagnate on the polishing pad 9. Wafers may be polluted by the metal components within the substrate 82 on the polishing pad 9 indirectly during the polishing process. Therefore, the structures of the conventional CMP conditioner still need to be improved.

SUMMARY OF THE INVENTION

The present invention ameliorates the CMP conditioner with structures in the prior art to reduce chances of contact between the substrate and the polishing pad, thereby decreasing dissolving out of metal components within the substrate and their stagnation on the polishing pad, which directly induces the pollution of the wafers during the polishing process.

The present invention provides a CMP conditioner comprising:

a substrate being circular and comprising a central surface, an outer surface encompassing the central surface, and multiple mounting holes recessed from the outer surface;

multiple abrasive bars respectively mounted in the mounting holes; each of the multiple abrasive bars comprising a bar body and an abrasive particle, the bar body comprising a top surface; the abrasive particle comprising a tip; the abrasive particle mounted on the top surface with the tip pointing away from the top surface; and multiple slide blocks mounted on the outer surface; each of the multiple slide blocks comprising a slide dressing surface facing away from the outer surface; the multiple slide blocks distributed among the mounting holes.

The CMP conditioner of the present invention may decrease contact between the polishing pad and the substrate by the slide blocks effectively. Furthermore, the corrosion of the substrate by the slurry also decreases and the metal components within the substrate may not dissolve out and stagnate on the polishing pad to pollute the wafers indirectly. In addition, the working area of the abrasive bars distributed on the outer surface is wide. The removing effect of the abrasive bars is uniform, and the efficiency of the abrasive bars is excellent.

Preferably, the straight distances between each of the multiple mounting holes and a center of the central surface are different. The distances between any two neighbors of the multiple mounting holes are different. This prevents the shadow effect occurring in the polishing process to the CMP conditioner.

Preferably, the substrate is made of stainless steel, ceramics, or engineering plastic. The bar body is made of stainless steel. The abrasive particles are artificial diamond, natural diamond, polycrystalline diamond, or cubic boron nitride. More preferably, the abrasive particles are applied by a surface treatment. The abrasive particles comprise specific dressing angles, specific crystal structures, or directionalities of tip to achieve the best polishing performance.

Preferably, the tip protrudes from the outer surface. The top surface is higher than the outer surface, or the top surface is lower than the outer surface.

Preferably, a height of the slide dressing surface is between the tip and the top surface or a height of the slide dressing surface is equal to a height of the tip.

Preferably, the multiple mounting notches are recessed from the outer surface. The mounting notches are distributed among the mounting holes. Each of the multiple slide blocks is correspondingly mounted in each of the multiple mounting notches. More preferably, the multiple slide blocks are arranged in a cross pattern, a radial pattern, or an asterisk pattern. In addition, the multiple slide blocks and the substrate are integrated.

Preferably, 5% to 25% of an area of the outer surface is occupied by the multiple slide blocks. If less than 5% of the outer surface is occupied by the multiple slide blocks, the multiple slide blocks may not be used as a cushion between the polishing mat and the substrate effectively. If larger than 25% of the outer surface is occupied by the multiple slide blocks, the space provided for mounting the abrasive bars may be reduced.

Preferably, an area of the central surface is 40% to 80% of the total area of the central surface and the outer surface. An area of the outer surface is 20% to 60% of the total area of the central surface and the outer surface. A vertical distance between the tip and the outer surface is 0.12 to 4.15 mm. A height difference between the height of the slide dressing surface and the height of the tip is 0.02 to 0.15 mm. A vertical distance between the height of the slide dressing surface and the height of the outer surface is 0.1 to 4 mm. If the vertical distance between the height of the slide dressing surface and the height of the outer surface is larger than 5 mm, the thickness of the CMP conditioner is too large and increases the cost of the CMP conditioner. Furthermore, it is easy to induce falling off of the abrasive bars if the abrasive bars are too much exposed on the substrate.

Preferably, the surface structure of the slide dressing surface is a smooth surface. If the surface structure of the slide dressing surface is a non-smooth surface, the non-smooth surface comprises multiple microstructures including multiple concave parts and convex parts. Preferably, a shape of each of the multiple slide blocks is circular, elliptical, polygonal, elongated, helical or fan-shaped.

Preferably, each of the slide dressing surfaces is consisting of cemented materials, noble metals, cubic boron nitride, sapphire, hard ceramic, diamond, diamond like carbon or engineering plastic. More preferably, the cemented materials comprise silicon carbide, tungsten carbide, or molybdenum carbide. The noble metals comprise gold, silver, titanium alloy, platinum-iridium alloy, thallium, or vanadium.

More preferably, each of the slide dressing surfaces is plated with a layer of diamond film.

In addition, the multiple slide blocks comprise first slide blocks and second slide blocks. The first slide blocks and the second slide blocks are arranged alternatively along the outer surface. Each of the first slide blocks comprises a first slide dressing surface away from the outer surface, and a surface structure of the first slide dressing surface is a non-smooth surface. The non-smooth surface comprises multiple microstructures including multiple concave parts and convex parts. A height of the first slide dressing surface is between a height of the tip and a height of the top surface. Each of the second slide blocks comprises a second slide dressing surface away from the outer surface, and a surface structure of the second slide dressing surface is a non-smooth surface. The non-smooth surface comprises multiple microstructures including multiple concave parts and convex parts. A height of the second slide dressing surface is between a height of the tip and a height of the top surface.

Preferably, a height of the first slide dressing surface is equal to a height of the second slide dressing surface or the height of the first slide dressing surface differs from the height of the second slide dressing surface. Preferably, a height of the second slide dressing surface is relatively lower than a height of the first slide dressing surface. A height difference between each of the height of the first slide dressing surface and each of the height of the second slide dressing surface is 20 to 50 μm.

Preferably, the shapes of the first slide blocks and the second slide blocks are circular, elliptical, polygonal, elongated, helical or fan-shaped.

Preferably, each of the second slide dressing surfaces is consisting of cemented materials, noble metals, cubic boron nitride, sapphire, hard ceramic, diamond, diamond like carbon or engineering plastic. More preferably, the cemented materials comprise silicon carbide, tungsten carbide, or molybdenum carbide. The noble metals comprise gold, silver, titanium alloy, platinum-iridium alloy, thallium, or vanadium.

More preferably, the second slide dressing surfaces are plated with a layer of diamond film.

The height of the second slide dressing surface is between the height of the tip and the height of the top surface. In other words, a protruding depth of the second slide dressing surface into the polishing mat is small than the height of the tip of the abrasive particles in the polishing process. The over coarsened parts of the polishing mat on its surface may be smoothened by the second slide dressing surface after the polishing process by abrasive particles. Furthermore, the height of the second slide dressing surface differs from the height of the first slide dressing surface. It is effective to help users to control the roughness of the surface with the polishing mat.

In addition, the multiple slide blocks comprise first slide blocks and second slide blocks. The first slide blocks and the second slide blocks are arranged alternatively along the outer surface. Each of the first slide blocks comprises a first slide dressing surface away from the outer surface, and a surface structure of the first slide dressing surface is a smooth surface. A height of the first slide dressing surface is between a height of the tip and a height of the top surface. Each of the second slide blocks comprises a second slide dressing surface away from the outer surface, and a surface structure of the second slide dressing surface is a non-smooth surface. The non-smooth surface comprises multiple microstructures including multiple concave parts and convex parts. A height of the second slide dressing surface is between a height of the tip and a height of the top surface. A height of the first slide dressing surface is relatively lower than a height of the second slide dressing surface. A difference in vertical distance between each of the heights of the first slide dressing surfaces and each of the heights of the second slide dressing surfaces is 30 to 70 μm.

BRIEF DESCRIPTION OF THE DRAWINGS

The patent or application file contains at least one drawing executed in color. Copies of the patent or patent application publication with color drawing(s) will be provided by the Office upon request and payment of the necessary fee.

DETAILED DESCRIPTION OF THE INVENTION

Embodiment 1

Figure 1:
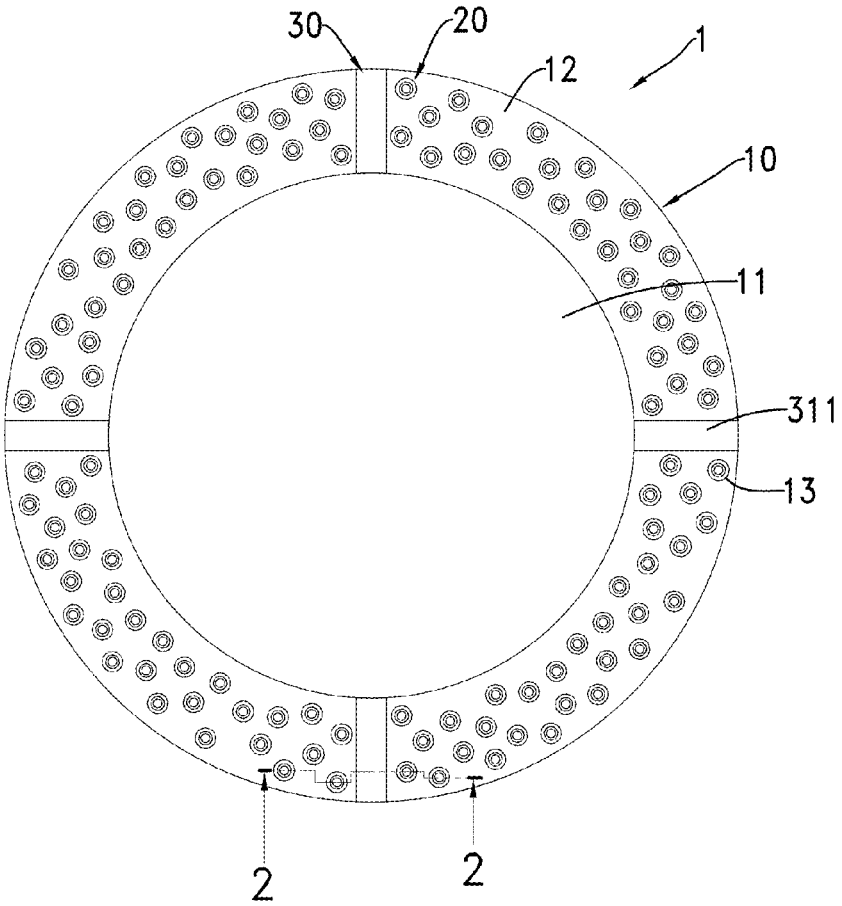
FIG. 1 is a top schematic view of a CMP conditioner in accordance with embodiment 1 of the present invention.
Figure 2:
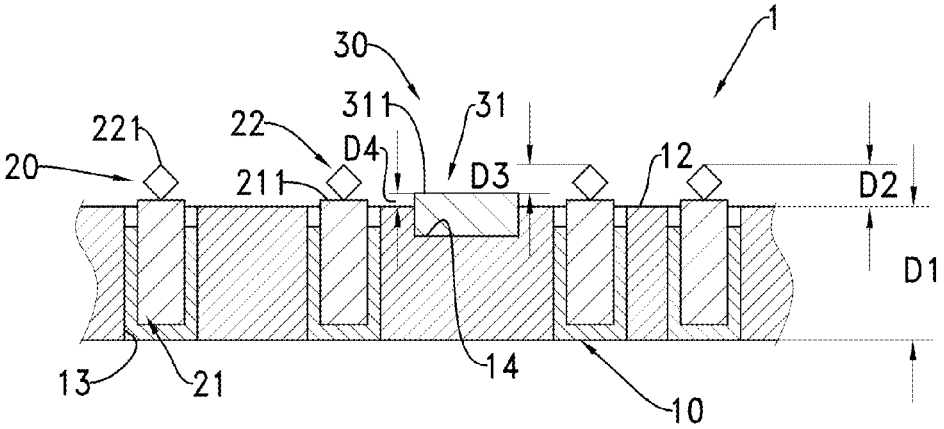
FIG. 2 is a cross-sectional schematic view of the CMP conditioner in accordance with embodiment 1 of the present invention.

With reference to FIGS. 1 and 2, a first embodiment of the present invention provides a CMP conditioner 1 comprising a substrate 10, multiple abrasive bars 20, and multiple slide blocks 30.

The substrate 10 is circular and comprises a surface. The surface is defined into a central surface 11 and an outer surface 12. The central surface 11 and the outer surface 12 are concentric. A concave part is formed in the central surface 11 of the surface. The outer surface 12 encompasses the central surface 11. Multiple mounting holes 13 and multiple mounting notches 14 are recessed in the outer surface 12 of the surface. The multiple mounting notches 14 are distributed among the multiple mounting holes 13. A sectional difference between the concave part and the outer surface 12 is 0.5 mm. A thickness D1 of the substrate 10 is 4 mm. Based on a total area of the central surface 11 and the outer surface 12, an area of the central surface 11 is 80% of the total area and an area of the outer surface 12 is 20% of the total area. Based on the area of the outer surface 12, an area of the multiple mounting holes 13 is 10% of the area of the outer surface 12. The substrate 10 is made of stainless steel. The straight distances between each of the multiple mounting holes 13 and a center of the central surface 11 are different. The distances between any two adjacent mounting holes 13 are different.

Each of the multiple abrasive bars 20 is correspondingly mounted in each of the multiple mounting holes 13. Each of the multiple abrasive bars 20 comprises a bar body 21 and an abrasive particle 22. The abrasive particle 22 is mounted with the bar body 21. The bar body 21 further comprises a top surface 211. A level of the top surface 211 is higher than a level of the outer surface 12. The abrasive particle 22 is mounted on the top surface 211. The abrasive particle 22 further comprises a tip 221, and the tip 221 is away from the top surface 211. A vertical distance D2 between the tip 221 and the outer surface 12 is 0.12 mm. The bar body 21 is made of stainless steel. The abrasive particle 22 is natural diamond.

Each of the multiple slide blocks 30 is corresponding to and mounted in the above-said multiple mounting notches 14. Specifically, the multiple slide blocks 30 are arranged in a cross pattern along the outer surface 12. The shape of each of the multiple slide blocks 30 is elongated. Each of the multiple slide blocks 30 comprises a slide dressing surface away from the outer surface 12. Specifically, the multiple slide blocks 30 are the first slide blocks 31. The slide dressing surface of the first slide block 31 is a first slide dressing surface 311. A surface structure of the first slide dressing surface 311 is a smooth surface. A height of the first slide dressing surface 311 (which means a vertical distance between the first slide dressing surface 311 and the outer surface 12) is between a height of the tip 221 (which means a vertical distance between the tip 221 and the outer surface 12) and a height of the outer surface 12 (which means a vertical distance between the top surface 211 and the outer surface 12). A height difference D3 between the height of the first slide dressing surface 311 and the height of the tip 221 is 0.02 mm. A vertical distance D4 between the height of the first slide dressing surface 311 and the height of the outer surface 12 is 0.1 mm. Based on the area of the outer surface 12, an area of the first slide dressing surface 311 occupied by the first slide blocks 31 is 5% of the area of the outer surface 12. A material of the first slide blocks 31 includes silicon carbide. The first slide dressing surface 311 is plated with a layer of diamond film.

Embodiment 2

Figure 3:
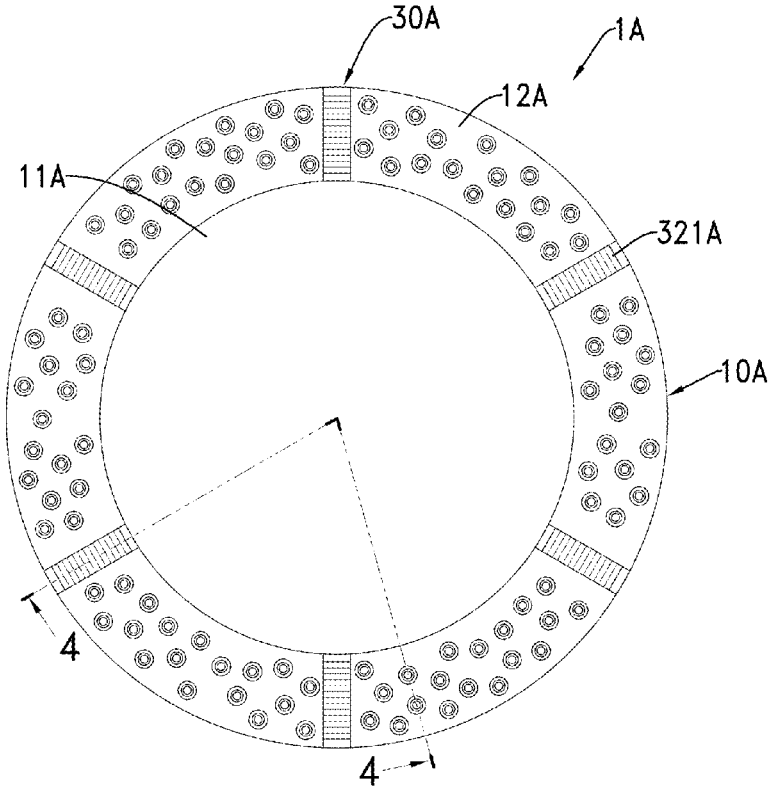
FIG. 3 is a top schematic view of a CMP conditioner in accordance with embodiment 2 of the present invention; p
Figure 4:
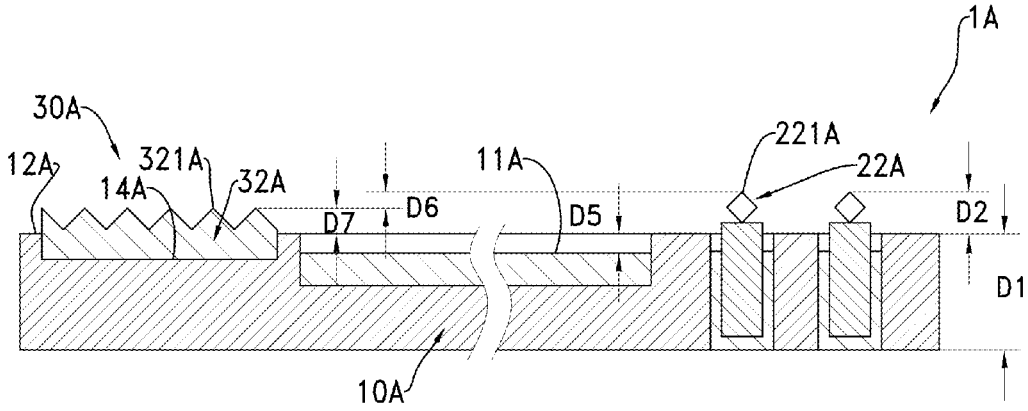
FIG. 4 is a cross-sectional schematic view of the CMP conditioner in accordance with embodiment 2 of the present invention.

With reference to FIGS. 3 and 4, a second embodiment of the present invention provides a CMP conditioner 1A. The CMP conditioner 1A is similar to the CMP conditioner 1. The difference between the CMP conditioner 1A and the CMP conditioner 1 is that multiple mounting notches 14A are arranged in a radial pattern along the outer surface 12. A sectional difference D5 between the concave part and the outer surface 12A is 1 mm. The thickness D1 of the substrate 10A is 5.25 mm. Based on a total area of the central surface 11A and the outer surface 12A, an area of the central surface 11A is 64% of the total area and an area of the outer surface 12A is 36% of the total area. Based on the area of the outer surface 12A, an area of the multiple mounting holes 13A is 31% of the area of the outer surface 12A. The substrate 10A is made of ceramics.

A vertical distance D2 between the tip 221A and the outer surface 12A is 0.25 mm. The abrasive particle 22A is cubic boron nitride.

Each of the multiple slide blocks 30A is a second slide block 32A. Each of the multiple slide blocks 30A comprises a slide dressing surface away from the outer surface 12A. The slide dressing surface of the second slide block 32A is a second slide dressing surface 321A. A surface structure of the second slide dressing surface 321A is a non-smooth surface. The non-smooth surface comprises multiple micro-structures including multiple concave parts and convex parts. A height of the second slide dressing surface 321A (which means a vertical distance between the second slide dressing surface 321A and the outer surface 12A) is between a height of the tip 221A and a height of the top surface 211A. A height difference D6 between the height of the second slide dressing surface 321A and the height of the tip 221A is 0.05 mm. A vertical distance D7 between the height of the second slide dressing surface 321A and the height of the outer surface 12A is 0.2 mm. Based on the area of the outer surface 12A, an area of the second slide block 32A is 10.8% of the area of the outer surface 12A. A material of the second slide blocks 32A includes cubic boron nitride. The second slide dressing surface 321A is plated with a layer of diamond film.

Embodiment 3

Figure 5:
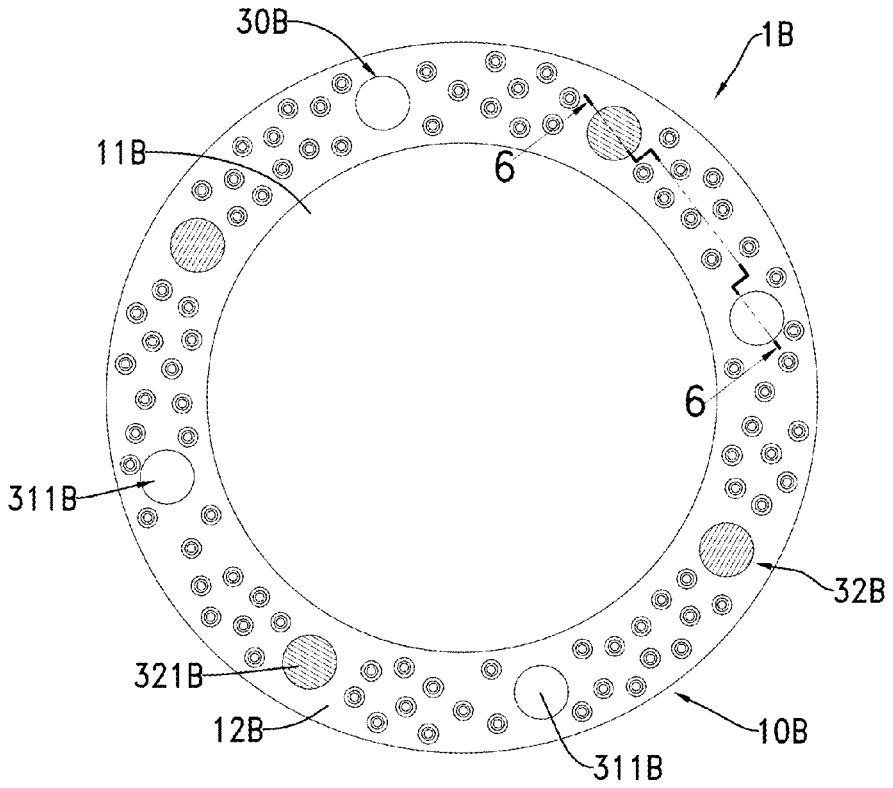
FIG. 5 is a top schematic view of a CMP conditioner in accordance with embodiment 3 of the present invention.
Figure 6:
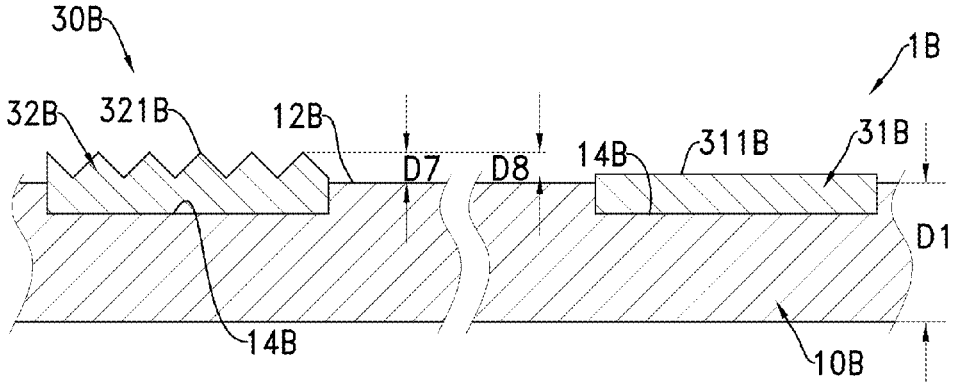
FIG. 6 is a cross-sectional schematic view of the CMP conditioner in accordance with embodiment 3 of the present invention.

With reference to FIGS. 5 and 6, a third embodiment of the present invention provides a CMP conditioner 1B. The CMP conditioner 1B is similar to the CMP conditioner 1. The difference between the CMP conditioner 1B and the CMP conditioner 1 is that a sectional difference between the concave part and the outer surface 12B is 3 mm. The thickness D1 of the substrate 10B is 7 mm. Based on a total area of the central surface 11B and the outer surface 12B, an area of the central surface 11B is 40% of the total area and an area of the outer surface 12B is 60% of the total area. Based on the area of the outer surface 12B, an area of the multiple mounting holes 13B is 50% of the area of the outer surface 12B. The substrate 10B is made of engineering plastic.

A vertical distance between the tip and the outer surface 12B is 4.15 mm.

The multiple slide blocks 30B are arranged in an asterisk pattern along the outer surface 12B. The multiple slide blocks 30B are divided into first slide blocks 31B and second slide blocks 32B. The first slide blocks 31B and the second slide blocks 32B are circular. The first slide blocks 31B and the second slide blocks 32B are arranged alternatively along the outer surface 12B. Each of the first slide blocks 31B comprises a first slide dressing surface 311B away from the outer surface 12B. A surface structure of the first slide dressing surface 311B is a smooth surface. A height of the first slide dressing surface 311B is between a height of the tip and a height of the top surface. Each of the second slide blocks 32B comprises a second slide dressing surface 321B away from the outer surface 12B. A surface structure of the second slide dressing surface 321B is a non-smooth surface. The non-smooth surface comprises multiple microstructures including multiple concave parts and convex parts. A height of the second slide dressing surface 321B is between a height of the tip and a height of the top surface. A height difference between the height of the second slide dressing surface 321B and the height of the tip is 0.15 mm. A vertical distance D7 between the height of the second slide dressing surface 321B and the height of the outer surface 12B is 4 mm. A height of each of the first slide dressing surfaces 311B is relatively lower than a height of each of the second slide dressing surfaces 321B. A height difference D8 between the height of the first slide dressing surface 311B and the height of the second slide dressing surface 321B is 50 μm. Based on the area of the outer surface 12B, a total area of an area of the second slide blocks 32B and an area of the first slide blocks 31B is 25% of the area of the outer surface 12B. A material of the first slide blocks 31B includes sapphire. A material of the second slide blocks 32B includes hard ceramics.

Embodiment 4

Figure 7:
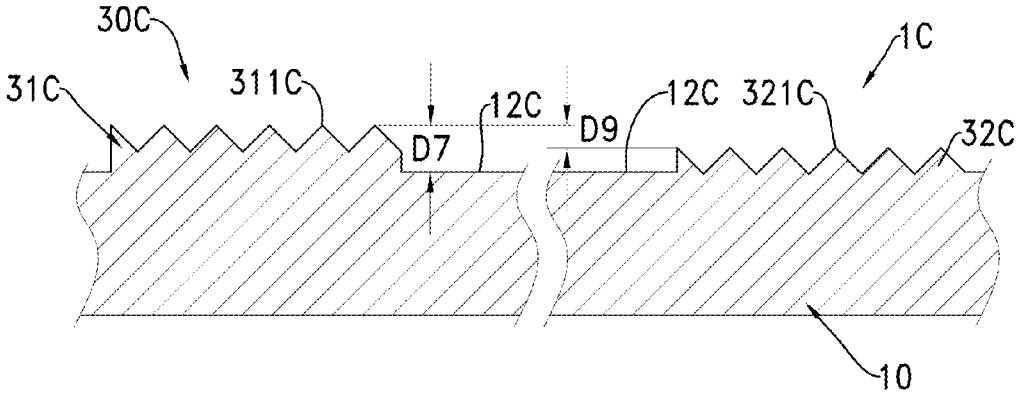
FIG. 7 is a cross-sectional schematic view of the CMP conditioner in accordance with embodiment 4 of the present invention.
Figure 8:
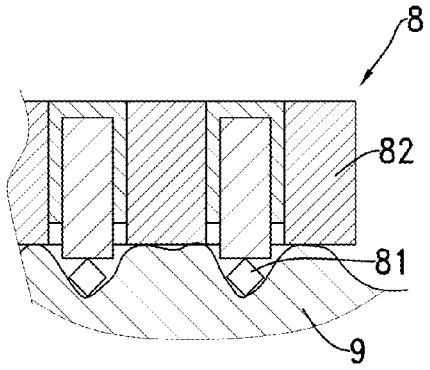
FIG. 8 is a cross-sectional schematic view of the prior art.

With reference to FIG. 7, a fourth embodiment of the present invention provides a CMP conditioner 1C. The CMP conditioner 1C is similar to the CMP conditioner 1. The difference between the CMP conditioner 1C and the CMP conditioner 1 is that the substrate 10C is made of engineering plastic. The multiple slide blocks 30C are also made of engineering plastic. The multiple slide blocks 30C and the substrate 10C are integrated. The multiple slide blocks 30C are divided into first slide blocks 31C and second slide blocks 32C. The first slide blocks 31C and the second slide blocks 32C are arranged alternatively along the outer surface 12C. Each of the first slide blocks 31C comprises a first slide dressing surface 311C away from the outer surface 12C. A surface structure of the first slide dressing surface 311C is a non-smooth surface. The non-smooth surface comprises multiple microstructures including multiple concave parts and convex parts. A height of the first slide dressing surface 311CB is between a height of the tip and a height of the top surface. Each of the second slide blocks 32C comprises a second slide dressing surface 321C away from the outer surface 12C. A surface structure of the second slide dressing surface 321C is a non-smooth surface. The non-smooth surface comprises multiple microstructures including multiple concave parts and convex parts. A height of the second slide dressing surface 321C (which means a vertical distance between the second slide dressing surface 321C and the outer surface 12C) is between a height of the tip and a height of the top surface. A height difference between the height of the first slide dressing surface 311C and the height of the tip is 0.15 mm. A vertical distance D7 between the height of the first slide dressing surface 311C and the height of the outer surface 12C is 4 mm. A height of each of the second slide dressing surfaces 321C is relatively lower than a height of each of the first slide dressing surfaces 311C. A height difference D9 between the height of the second slide dressing surface 321C and the height of the first slide dressing surface 311C is 35 μm. Based on the area of the outer surface 12C, a total area of an area of the first slide blocks 31C and an area of the second slide blocks 32C is 25% of the area of the outer surface 12C.

When the CMP conditioner 1C is used as a polishing mat, the abrasive particles are used to polish a surface of the polishing mat. The polishing mat may maintain a specific roughness of the surface with the polishing mat. The height of the first slide dressing surface 311C and the height of the second slide dressing surface 321C are between the height of the tip and the height of the top surface. This means the tip protruding into the polishing mat is deeper than the first slide dressing surface 311C and the second slide dressing surface 321C in the polishing process. The surface of the polishing mat is over coarse. If the tip acts in concert with the first slide dressing surface 311C and the second slide dressing surface 321C that may protrude into the polishing deeper, the CMP conditioner 1C may remove protrusions on the surface of the polishing mat and smoothen the surface of the polishing mat. It is effective to reduce the roughness of the surface with the polishing mat.

Comparative Example

A CMP conditioner 8 in this comparative example is similar to the CMP conditioner 1 in the embodiment 1. The difference between the CMP conditioner 8 and the CMP conditioner 1 is that the CMP conditioner 8 has no slide block.

Testing

Figure 9:
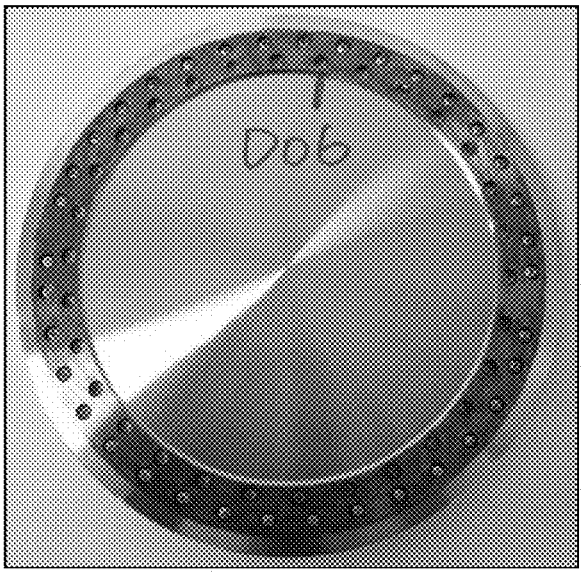
FIG. 9 is a photo of the CMP conditioner in the comparative example during the testing before the polishing process.
Figure 10:
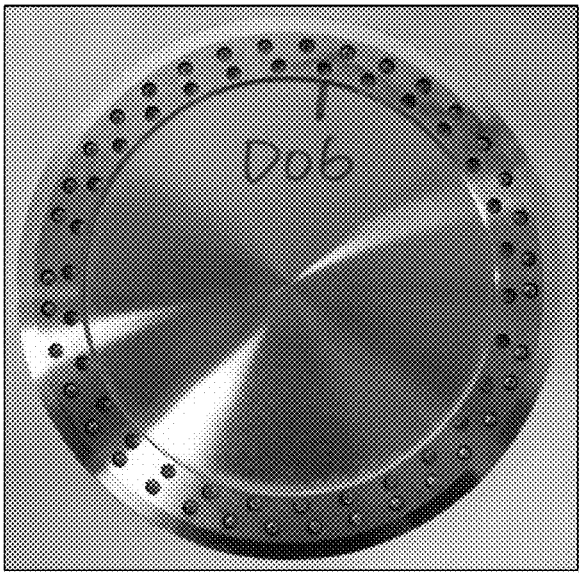
FIG. 10 is a photo of the CMP conditioner in the comparative example during the testing after the polishing process.
Figure 11:
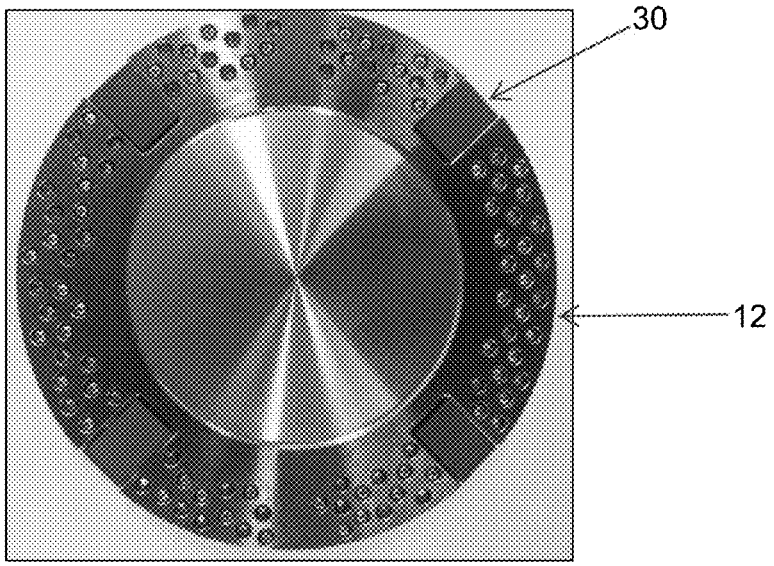
FIG. 11 is a photo of the CMP conditioner in embodiment 1 during the testing before the polishing process.

With reference to FIGS. 9 and 11, a red color layer was coated on an outer surface of the CMP conditioner 8 in the comparative example and an outer surface of the CMP conditioner 1 in embodiment 1 respectively. Then the CMP conditioner 8 and the CMP conditioner 1 were used to polish the polishing mat respectively. The pressure applied on the CMP conditioner 8 and the CMP conditioner 1 was 3.5 kg. The results are shown in the FIGS. 9 to 12.

Figure 12:
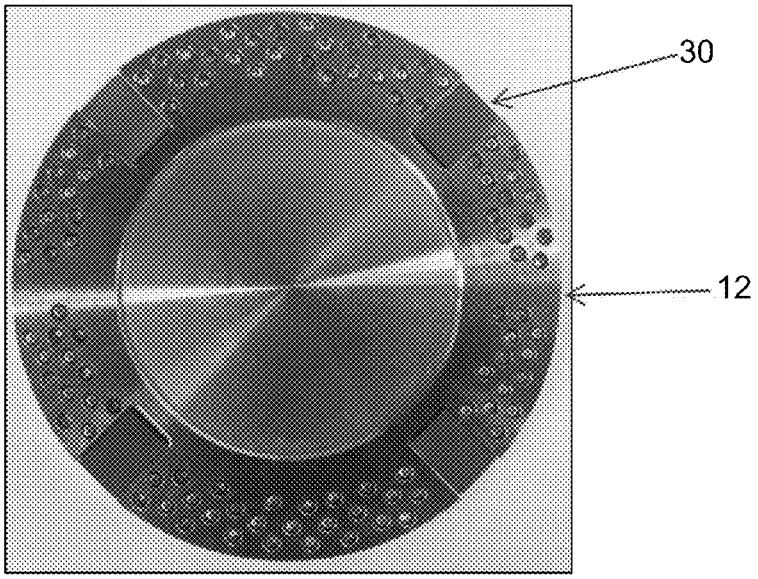
FIG. 12 is a photo of the CMP conditioner in embodiment 1 during the testing after the polishing process.

With reference to FIGS. 9 and 10, the red color layer on the outer surface of the CMP conditioner 8 in the comparative example disappeared after the polishing process. Slurry was in contact with the outer surface of the CMP conditioner 8 continuously, and the red color layer was washed away by the slurry in the polishing process. With reference to FIGS. 11 and 12, the red color layer on the outer surface 12 of the CMP conditioner 1 in the embodiment 1 was similar as before. The slide blocks 30 were used to reduce the contact between the outer surface of the CMP conditioner 1 and the polishing mat in the polishing process. Accordingly, FIG. 12 show no color loss due to reduction of contact.

The CMP conditioner of the present invention utilizes the slide blocks to reduce the contact between the substrate of the CMP conditioner and the polishing mat efficiently. The slide blocks may also prevent the pollution to the polishing mat and wafer by the metal ions from the slurry.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A chemical mechanical polishing conditioner comprising:

a substrate being circular and comprising a central surface, an outer surface encompassing the central surface, and multiple mounting holes recessed from the outer surface;

multiple abrasive bars respectively mounted in the mounting holes; each of the multiple abrasive bars comprising a bar body and an abrasive particle, the bar body comprising a top surface; the abrasive particle comprising a tip; the abrasive particle mounted on the top surface with the tip pointing away from the top surface; and multiple slide blocks mounted on the outer surface; each of the multiple slide blocks comprising a slide dressing surface facing away from the outer surface; the multiple slide blocks distributed among the mounting holes.

2. The chemical mechanical polishing conditioner as claimed in claim 1, wherein the tip protrudes from the outer surface; the top surface is higher than the outer surface, or the top surface is lower than the outer surface.

3. The chemical mechanical polishing conditioner as claimed in claim 1, wherein a height of the slide dressing surface is between the tip and the top surface; or the height of the slide dressing surface is equal to a height of the tip.

4. The chemical mechanical polishing conditioner as claimed in claim 1, wherein multiple mounting notches are recessed from the outer surface; the mounting notches are distributed among the mounting holes; the multiple slide blocks are respectively mounted in the multiple mounting notches.

5. The chemical mechanical polishing conditioner as claimed in claim 1, wherein the multiple slide blocks and the substrate are integrated.

6. The chemical mechanical polishing conditioner as claimed in claim 1, wherein 5% to 25% of an area of the outer surface is occupied by the multiple slide blocks.

7. The chemical mechanical polishing conditioner as claimed in claim 1, wherein a surface structure of the slide dressing surface is a smooth surface.

8. The chemical mechanical polishing conditioner as claimed in claim 1, wherein a surface structure of the slide dressing surface is a non-smooth surface; the non-smooth surface comprises multiple microstructures including multiple concave parts and convex parts.

9. The chemical mechanical polishing conditioner as claimed in claim 1, wherein the multiple slide blocks are arranged in a cross pattern, a radial pattern, or an asterisk pattern.

10. The chemical mechanical polishing conditioner as claimed in claim 1, wherein the slide dressing surface is consisting of silicon carbide, cubic boron nitride, sapphire, hard ceramic, diamond, diamond like carbon or combination thereof.

11. The chemical mechanical polishing conditioner as claimed in claim 10, wherein the slide dressing surface is plated with a layer of diamond film.

12. The chemical mechanical polishing conditioner as claimed in claim 1, wherein a shape of each of the multiple slide blocks is circular, elliptical, polygonal, elongated, helical or fan-shaped.

13. The chemical mechanical polishing conditioner as claimed in claim 1, wherein the multiple slide blocks comprise first slide blocks and second slide blocks; the first slide blocks and the second slide blocks are arranged alternatively along the outer surface; each of the first slide blocks comprises a first slide dressing surface away from the outer surface, and each of the second slide blocks comprises a second slide dressing surface away from the outer surface.

14. The chemical mechanical polishing conditioner as claimed in claim 13, wherein a height of the first slide dressing surface is equal to a height of the second slide dressing surface.

15. The chemical mechanical polishing conditioner as claimed in claim 13, wherein a height of the first slide dressing surface differs from a height of the second slide dressing surface.

16. The chemical mechanical polishing conditioner as claimed in claim 13, wherein a surface structure of the first slide dressing surface and a surface structure of the second slide dressing surface are smooth surfaces.

17. The chemical mechanical polishing conditioner as claimed in claim 13, wherein a surface structure of the first slide dressing surface and a surface structure of the second slide dressing surface are non-smooth surfaces; the non-smooth surfaces comprise multiple microstructures including multiple concave parts and convex parts.

18. The chemical mechanical polishing conditioner as claimed in claim 13, wherein a surface structure of the first slide dressing surface is a smooth surface; a surface structure of the second slide dressing surface is a non-smooth surface; the non-smooth surface comprises multiple microstructures including multiple concave parts and convex parts.

19. The chemical mechanical polishing conditioner as claimed in claim 13, wherein the first slide blocks and the second slide blocks are arranged in a cross pattern, a radial pattern, or an asterisk pattern.

20. The chemical mechanical polishing conditioner as claimed in claim 13, wherein the first slide dressing surface and the second slide dressing surface are consisting of silicon carbide, cubic boron nitride, sapphire, hard ceramic, diamond, diamond like carbon or combination thereof.

21. The chemical mechanical polishing conditioner as claimed in claim 13, wherein the first slide dressing surface and the second slide dressing surface are respectively plated with a layer of diamond film.

22. The chemical mechanical polishing conditioner as claimed in claim 13, shapes of the first slide blocks and the second slide blocks are circular, elliptical, polygonal, elongated, helical or fan-shaped.

* * * * *